US010959301B1

(12) United States Patent
Lu et al.

(10) Patent No.: US 10,959,301 B1
(45) Date of Patent: Mar. 23, 2021

(54) POLARITY CORRECTION CIRCUIT FOR DIMMER

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Xiamen (CN)

( * ) Notice: Subject to any disclaimer, the term of this patent is extended or adjusted under 35 U.S.C. 154(b) by 0 days.

(21) Appl. No.: 16/879,794

(22) Filed: May 21, 2020

(30) Foreign Application Priority Data

Feb. 17, 2020 (CN) ..... 202010097259.8

(51) Int. Cl.

| | |
|---|---|
| ***H05B 45/14*** | (2020.01) |
| ***H05B 45/31*** | (2020.01) |
| ***H05B 45/325*** | (2020.01) |
| ***H05B 45/46*** | (2020.01) |
| ***H05B 45/44*** | (2020.01) |

(52) U.S. Cl.
CPC ..... *H05B 45/14* (2020.01); *H05B 45/31* (2020.01); *H05B 45/325* (2020.01)

(58) Field of Classification Search
CPC ..... H05B 45/14; H05B 45/24; H05B 45/31; H05B 45/325; H05B 45/3577; H05B 45/327; H05B 45/372; H05B 45/44; H05B 45/46; H05B 45/48; H05B 45/50
See application file for complete search history.

(56) References Cited

U.S. PATENT DOCUMENTS

2009/0039854 A1* 2/2009 Blakeley ..... H05B 39/08 323/285

* cited by examiner

*Primary Examiner* — Wei (Victor) Y Chan
(74) *Attorney, Agent, or Firm* — Winston Hsu

(57) ABSTRACT

A polarity correction circuit for dimmer includes a control circuit, an adjustment circuit, and a detection circuit. The adjustment circuit is connected to the control circuit, a working voltage input end, and a dimmer, and the adjustment circuit includes several switches. The adjustment circuit receives a dimming signal of the dimmer. The detection circuit is connected to the dimmer and the control circuit, the detection circuit detects the dimming signal to generate a reference voltage, and the detection circuit transmits the reference voltage to the control circuit. The control circuit maintains the switch states of the switches of the adjustment circuit unchanged or adjust the switch states of the switches of the adjustment circuit according to the reference voltage.

14 Claims, 8 Drawing Sheets

POLARITY CORRECTION CIRCUIT FOR DIMMER

CROSS REFERENCE TO RELATED APPLICATION

This application claims the benefit of priority of China Patent Application No. 202010097259.8, filed 2020 Feb. 17, and which is included herein by reference in its entirety.

BACKGROUND OF THE INVENTION

1. Field of the Invention

The present invention relates to a polarity correction circuit for a dimmer.

2. Description of the Prior Art

Due to advancements of technologies, LED lamps are developed to have more functions and less manufacturing costs, thereby being utilized more widely. In general, upon the installation of the LED lamps, the technician has to notice if the connection polarity of the dimmer to be connected to the LED lamp is correct or not to prevent the LED lamp from working abnormally.

However, when the technician has to install a plenty of LED lamps, some of the LED lamps may be installed incorrectly. When several LED lamps are in parallel connection with each other with one of the LED lamps having a wrong connection polarity with the dimmer, the technician has to check the LED lamps one-by-one, which is time consuming.

SUMMARY OF THE INVENTION

In view of these, an embodiment of the present invention provides a polarity correction circuit for dimmer. The polarity correction circuit comprises a control circuit, an adjustment circuit, and a detection circuit. The adjustment circuit is connected to the control circuit, a working voltage input end, and a dimmer, and the adjustment circuit comprises a plurality of switches. The adjustment circuit can receive a dimming signal of the dimmer. The detection circuit is connected to the dimmer and the control circuit, and the detection circuit can detect the dimming signal to generate a reference voltage. The detection circuit can transmit the reference voltage to the control circuit. The control circuit can maintain a switch state of the switches of the adjustment circuit unchanged or can adjust the switch state of the switches of the adjustment circuit according to the reference voltage.

In one embodiment, the control circuit can generate a control signal according to the reference voltage, and the control circuit can output the control signal to a light source driver.

In one embodiment, the control signal may be a pulse width modulation signal.

In one embodiment, the control circuit can adjust a duty ratio of the pulse width modulation signal according to the reference voltage.

In one embodiment, when the reference voltage is greater than a first threshold value, the control circuit maintains the switch state of the switches of the adjustment circuit unchanged.

In one embodiment, the first threshold value is 0.38 V.

In one embodiment, when the reference voltage is less than a second threshold value, the control circuit adjusts the switch state of the switches of the adjustment circuit to reverse a polarity of the dimming signal.

In one embodiment, the second threshold value is 0.36 V.

In one embodiment, the control circuit comprises a first transistor, a second transistor, a third transistor, and a fourth transistor. A first end of the first transistor is connected to the working voltage input end, a second end of the first transistor is connected to a first dimming signal output end, a third end of the first transistor is connected to the control circuit. A first end of the second transistor is grounded, a second end of the second transistor is connected to the first dimming signal output end, and a third end of the second transistor is connected to the control circuit. A first end of the third transistor is connected to the working voltage input end, a second end of the third transistor is connected to a second dimming signal output end, a third end of the third transistor is connected to the control circuit. A first end of the fourth transistor is grounded, a second end of the fourth transistor is connected to the second dimming signal output end, and a third end of the fourth transistor is connected to the control circuit. The first dimming signal output end and the second dimming signal output end receive and output the dimming signal.

In one embodiment, the first transistor and the third transistor may be of a first type transistor, and the second transistor and the fourth transistor may be of a second type transistor.

In one embodiment, the first type transistor may be a p-MOSFET, and the second type transistor may be an n-MOSFET.

In one embodiment, the first type transistor may be an n-MOSFET, and the second type transistor may be a p-MOSFET.

In one embodiment, when the reference voltage is greater than a first threshold value, the control circuit allows the first transistor to be in connection with the fourth transistor.

In one embodiment, when the reference voltage is less than a second threshold value, the control circuit allows the second transistor to be in disconnection with the third transistor.

In one embodiment, the detection circuit comprises a first resistor, a first capacitor, a second resistor, and a second capacitor. One of two ends of the first resistor is connected to a first dimming signal output end, and the other end of the first resistor is connected to a common node. The first capacitor is in parallel connection with the first resistor. One of two ends of the second resistor is connected to a second dimming signal output end, and the other end of the second resistor is connected to the common node. The second capacitor is in parallel connection with the second resistor.

According to one or more embodiments of the present invention, the polarity correction circuit has following features.

(1) In one embodiment of the present invention, the polarity correction circuit has the adjustment circuit and the detection circuit, so that the connection polarity of the dimmer can be detected if it is correct using the detection circuit, and when the connection polarity of the dimmer is wrong, the adjustment circuit can provide the polarity correction function. Therefore, the LED lamp connected to the dimmer can work normally.

(2) In one embodiment of the present invention, a special H bridge structure is adopted for the adjustment circuit of the polarity correction circuit. Hence, the connection polarity of the dimmer can be checked effectively through a simple mechanism, and the connection polarity can be corrected instantly when the connection polarity of the dimmer is wrong.

(3) In one embodiment of the present invention, the detection circuit of the polarity correction circuit has a greater filtering function so as to generate a reference signal with low noises. Hence, the control circuit can recognize the reference signal accurately, thereby further improving the performance of the polarity correction circuit.

(4) In one embodiment of the present invention, the polarity correction circuit may not only be applicable to an active dimmer but also a passive dimmer. Hence, the polarity correction circuit can be used flexibly and widely.

(5) In one embodiment of the present invention, the circuit of the polarity correction circuit is simple. Hence, the expected performance can be achieved without greatly increasing the manufacturing costs of circuit. Accordingly, the polarity correction circuit has commercial value.

These and other objectives of the present invention will no doubt become obvious to those of ordinary skill in the art after reading the following detailed description of the preferred embodiment that is illustrated in the various figures and drawings.

DETAILED DESCRIPTION

Embodiments of a polarity correction circuit for dimmer provided by the present invention will be described below with reference to the relevant figures. For the sake of clarity and convenience in the description of the figures, the various components of the figures may be exaggerated or reduced in size and proportion. In the following description and/or claims, when referring to a component "connected" or "coupled" to another component, it may be directly connected or coupled to that other component or an intervening component may exist; and when referring to a component "directly connected" or "directly coupled" to another component, no intervening component exists and other words used to describe the relationship between components or layers shall be construed in the same manner. For ease of understanding, the same components in the following embodiments are indicated by the same reference numbers.

Figure 1:
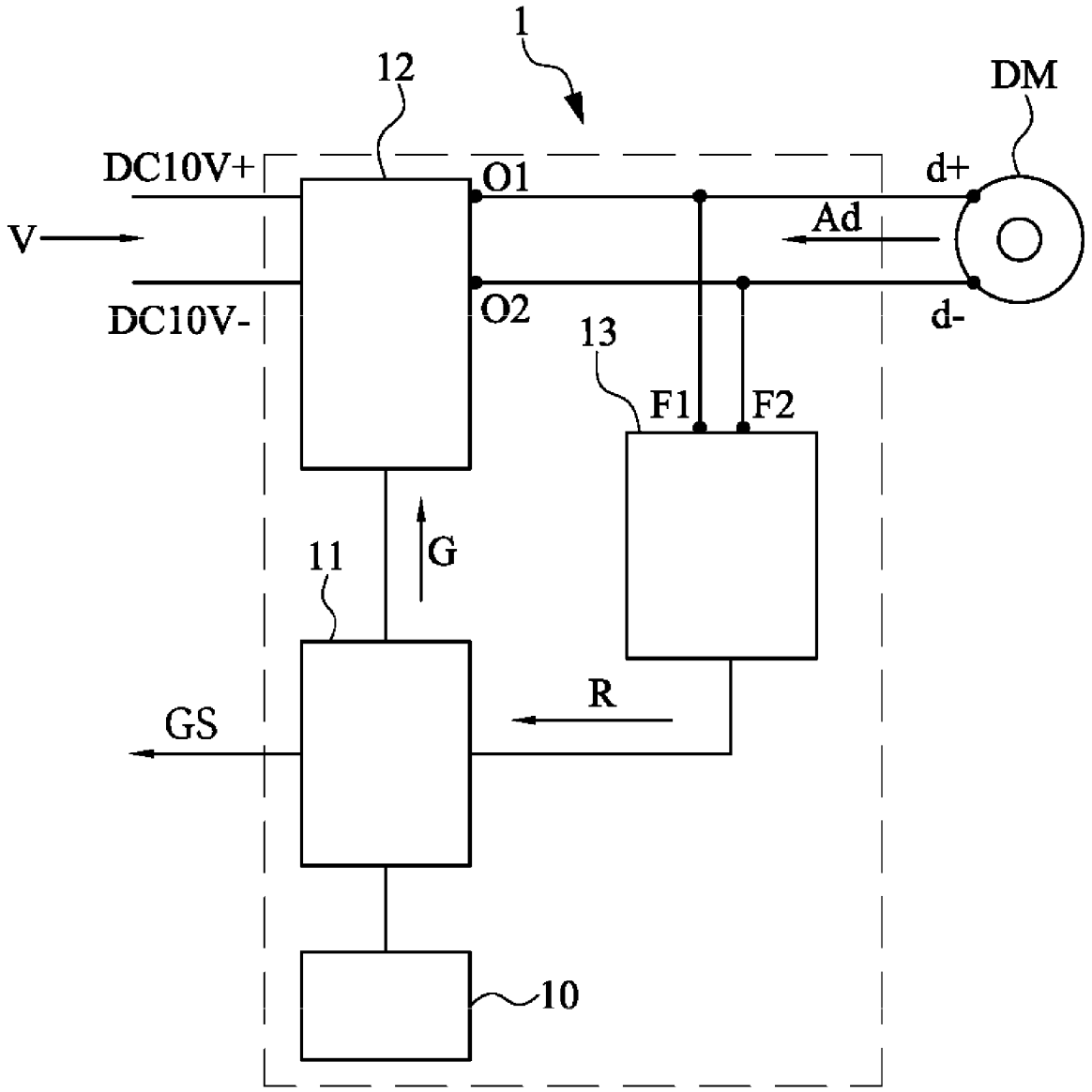
FIG. 1 illustrates a block diagram of a polarity correction circuit for dimmer according to a first embodiment of the present invention.

Please refer to FIG. 1, which illustrates a block diagram of a polarity correction circuit for dimmer according to a first embodiment of the present invention. As shown, the polarity correction circuit for dimmer (short for polarity correction circuit 1) may be connected to a dimmer DM, and the polarity correction circuit 1 comprises a control circuit 11, an adjustment circuit 12, a detection circuit 13, and a power supply 10.

The power supply 10 is connected to the control circuit 11 to provide electricity for the control circuit 11 so as to drive the control circuit 11.

The adjustment circuit 12 is connected to the control circuit 11, a working voltage input end, and the dimmer DM, and the adjustment circuit 12 comprises a plurality of switches. The adjustment circuit 12 has a first dimming signal output end O1 and a second dimming signal output end O2 respectively connected to the positive electrode d+ and the negative electrode d− of the dimmer DM. The adjustment circuit 12 can receive the dimming signal Ad of the dimmer DM. The working voltage input end inputs a working voltage V to the adjustment circuit 12.

The detection circuit 13 has a first detection end F1 and a second detection end F2 respectively connected to the positive electrode d+ and the negative electrode d− of the dimmer DM. The detection circuit 13 detects the dimming signal Ad to generate a reference voltage R, and the detection circuit 13 transmits the reference voltage R to the control circuit 11.

The control circuit 11 can determine if the connection polarity of the dimmer DM is correct or not according to the reference voltage R, so that the control circuit 11 can determine to maintain the switch state of the switches of the adjustment circuit 12 unchanged or to adjust the switch state of the switches of the adjustment circuit 12. In one embodiment, the control circuit 11 may be a microcontroller, a single-chip microcomputer (SCM), a circuit composed of operational amplifiers and comparators, or other similar circuits.

When the reference voltage R is greater than a first threshold value, the control circuit 11 determines the connection polarity of the dimmer DM is correct; at this case, the control circuit 11 maintains the switch state of the switches of the adjustment circuit 12 unchanged. Conversely, when the reference voltage R is less than a second threshold value, the control circuit 11 determines the connection polarity of the dimmer DM is wrong; at this case, the control circuit 11 adjusts the switch state of the switches of the adjustment circuit 12 so as to reverse the connection polarity of the dimmer DM. In one embodiment, the first threshold value may be 0.38 V, but embodiments are not limited thereto. In one embodiment, the second threshold value may be 0.36 V, but embodiments are not limited thereto.

As it can be seen from the figures, the positive electrode d+ of the dimmer DM is connected to the first dimming signal output end O1, and the negative electrode d− of the dimmer DM is connected to the second dimming signal output end O2. When the connection polarity of the dimmer DM meets the switch state of the switches of the adjustment circuit 12, the reference voltage R will be greater than the first threshold value. Therefore, the control circuit 11 determines the connection polarity of the dimmer DM is correct, and maintains the switch state of the switches of the adjustment circuit 12 unchanged.

Conversely, when the connection polarity of the dimmer DM does not meet the switch state of the switches of the adjustment circuit 12, the reference voltage R will be less than the second threshold value. Therefore, the control circuit 11 determines the connection polarity of the dimmer DM is wrong, and the control circuit 11 transmits a switch signal G to the adjustment circuit 12 so as to adjust the switch state of the switches of the adjustment circuit 12 to reverse the connection polarity of the dimmer DM.

Next, according to the reference voltage R occurred when the connection polarity of the dimmer DM is correct, the control circuit 11 can generate a control signal GS. The control signal GS may be a pulse width modulation (PWM) signal. The control circuit 11 may adjust the duty ratio of the control signal GS according to the reference voltage R and inputs the control signal GS to a light source driver of a LED lamp so as to perform the dimming function for the LED lamp.

Based on the above, the polarity correction circuit 1 can detect if the connection polarity of the dimmer DM is correct or not effectively; when the connection polarity of the dimmer DM is wrong, the polarity correction circuit 1 can perform polarity correction for the dimmer DM through the adjustment circuit 12, so that the LED can work normally. Hence, the automatic polarity correction mechanism allows the dimming signal Ad of the dimmer DM to have a nonpolar output feature.

Nevertheless, it is understood that the foregoing descriptions are provided as illustrative examples; the components within the polarity correction circuit 1 and the corporations thereof may be altered according to actual needs, embodiments are not limited thereto.

Figure 2:
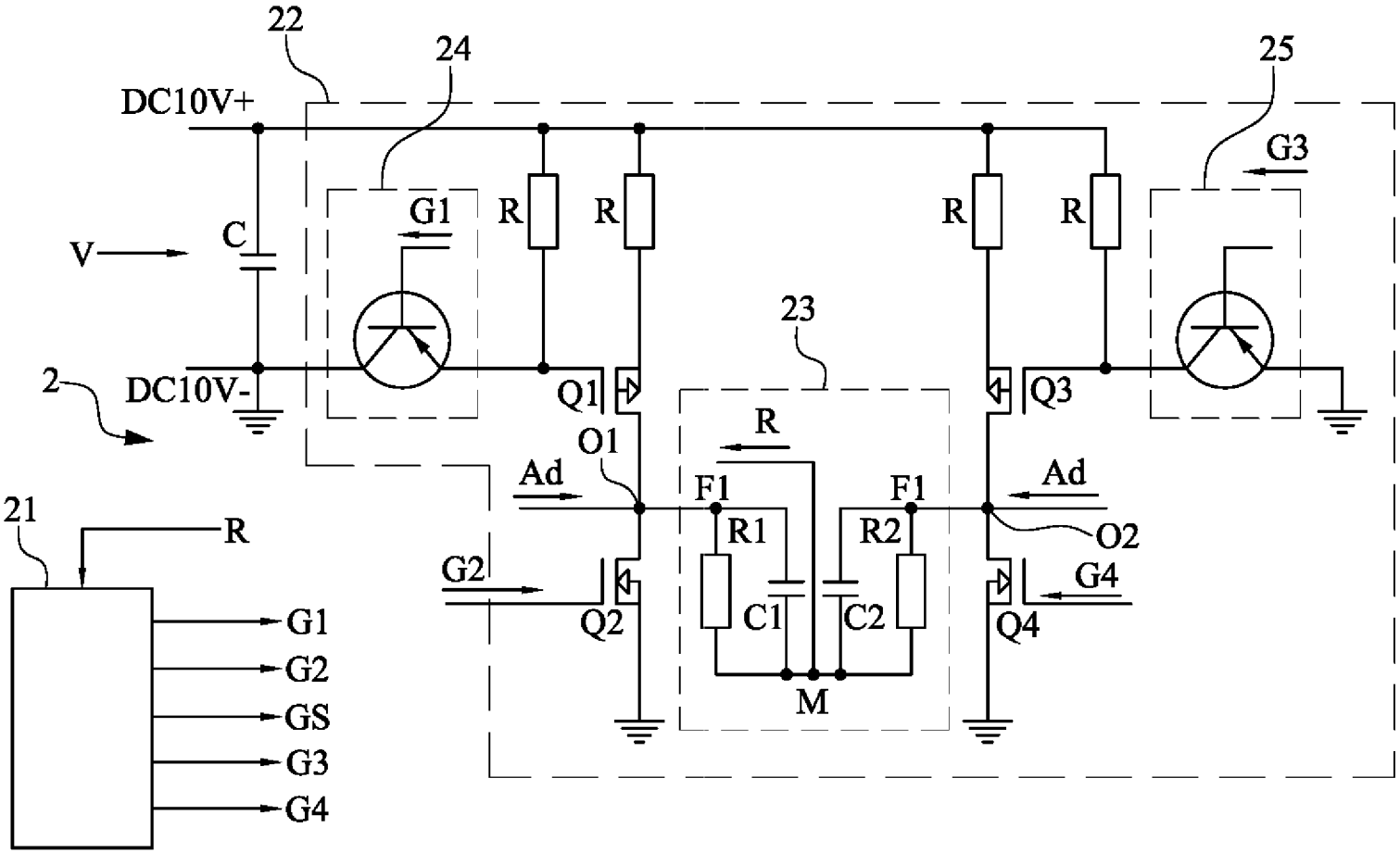
FIG. 2 illustrates a circuit diagram of a polarity correction circuit for dimmer according to a second embodiment of the present invention.

Please refer to FIG. 2, which illustrates a circuit diagram of a polarity correction circuit for dimmer according to a second embodiment of the present invention. As shown, the polarity correction circuit for dimmer (short for polarity correction circuit 2) comprises a control circuit 21, an adjustment circuit 22, a detection circuit 23, a first auxiliary circuit 24, and a second auxiliary circuit 25.

The adjustment circuit 22 is connected to the control circuit 21 and the working voltage input end. The adjustment circuit 22 may be an H bridge circuit comprising a first transistor Q1, a second transistor Q2, a third transistor Q3, and a fourth transistor Q4. The adjustment circuit 12 has a first dimming signal output end O1 and a second dimming signal output end O2 respectively connected to the dimmer. The adjustment circuit 22 can receive the dimming signal Ad of the dimmer from the first dimming signal output end O1 and the second dimming signal output end O2. The working voltage input end inputs a working voltage V to the adjustment circuit 22. The first transistor Q1 and the third transistor Q3 are of a first type transistor, and the second transistor Q2 and the fourth transistor Q4 are of a second type transistor. In this embodiment, the first type transistor may be a P-type metal-oxide-semiconductor field-effect transistor (p-MOSFET), and the second type transistor may be an N-type metal-oxide-semiconductor field-effect transistor (n-MOSFET), but embodiments are not limited thereto. In another embodiment, the first type transistor may be an n-MOSFET, and the second type transistor may be a p-MOSFET, but embodiments are not limited thereto. In yet another embodiment, the first transistor Q1, the second transistor Q2, the third transistor Q3, and the fourth transistor Q4 may be bipolar junction transistors (BJT). For example, the first transistor Q1 and the third transistor Q3 may be PNP-type BJTs, and the second transistor Q2 and the fourth transistor Q4 may be NPN-type BJTs. It is understood that, the first transistor Q1 and the third transistor Q3 of course may be NPN-type BJTs, and the second transistor Q2 and the fourth transistor Q4 of course may be PNP-type BJTs.

More specifically, in the second embodiment, the first end (source) of the first transistor Q1 is connected to the working voltage input end through a resistor R, the second end (drain) of the first transistor Q1 is connected to the first dimming signal output end O1, and the third end (gate) of the first transistor Q1 is connected to the control circuit 21 through the first auxiliary circuit 24. The first end (source) of the second transistor Q2 is grounded, the second end (drain) of the second transistor Q2 is connected to the first dimming signal output end O1, and the third end (gate) of the second transistor Q2 is connected to the control circuit 21. The first end (source) of the third transistor Q3 is connected to the working voltage input end, the second end (drain) of the third transistor Q3 is connected to the second dimming signal output end O2, and the third end (gate) of the third transistor Q3 is connected to the control circuit 21 through the second auxiliary circuit 25. The first end (source) of the fourth transistor Q4 is grounded, the second end (drain) of the fourth transistor Q4 is connected to the second dimming signal output end O2, and the third end (gate) of the fourth transistor Q4 is connected to the control circuit 21. The first auxiliary circuit 24 and the second auxiliary circuit 25 may be BJTs, and the first auxiliary circuit 24 and the second auxiliary circuit 25 are provided for increasing the cut-off voltages of the first transistor Q1 and the third transistor Q3 (which are p-MOSFETs).

The detection circuit 23 has a first detection end F1 and a second detection end F2 respectively connected to the dimmer. The detection circuit 23 detects the dimming signal Ad to generate the reference voltage R and transmits the reference voltage R to the control circuit 21. More specifically, in the second embodiment, the detection circuit 23 comprises a first resistor R1, a first capacitor C1, a second resistor R2, and a second capacitor C2. One of two ends of the first resistor R1 is connected to the first dimming signal output end O1, and the other end of the first resistor R1 is connected to a common node M. The first capacitor C1 is in parallel connection with the first resistor R1. One of two ends of the second resistor R2 is connected to the second dimming signal output end O2, and the other end of the second resistor R2 is connected to the common mode M, so that the first resistor R1 is in serial connection with the second resistor R2. The second capacitor C2 is in parallel connection with the second resistor R2. The first resistor R1 and the second resistor R2 can form a voltage dividing circuit to capture the reference voltage R at the common node M. The first capacitor C1 and the second capacitor C2 can provide a filtering function so as to filter noises from the reference voltage R, so that the reference voltage R can be recognized easily.

Similarly, the control circuit 21 can determine if the connection polarity of the dimmer is correct or not according to the reference voltage R, so that the control circuit 21 can determine to maintain the switch state of the switches of the adjustment circuit 22 unchanged or to adjust the switch state of the switches of the adjustment circuit 22. The control circuit 21 can adjust the switch state through transmitting switch signals G1, G2, G3, G4 to the first transistor Q1, the second transistor Q2, the third transistor Q3, and the fourth transistor Q4, respectively.

Figure 3:
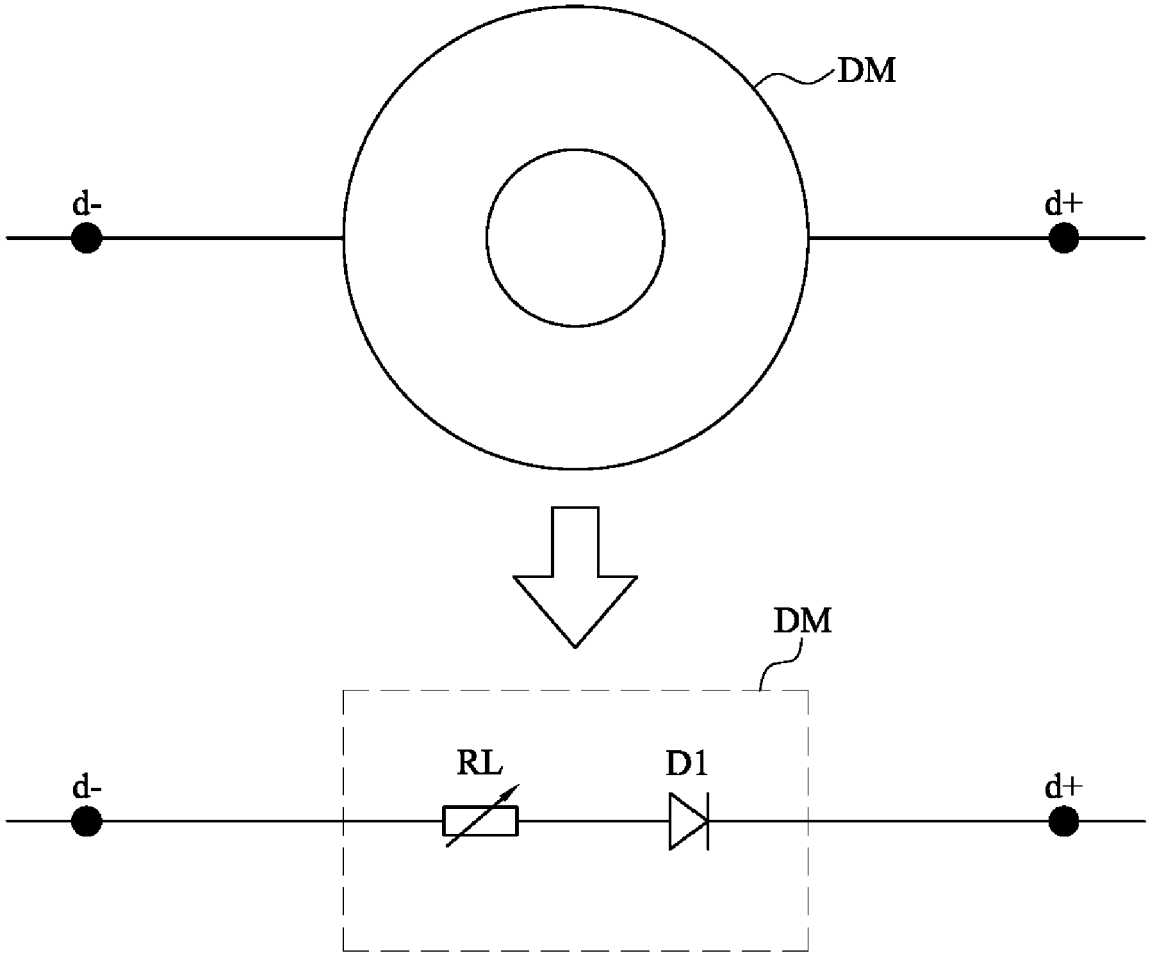
FIG. 3 illustrates an equivalent circuit diagram of the dimmer of the second embodiment.
Figure 4A:
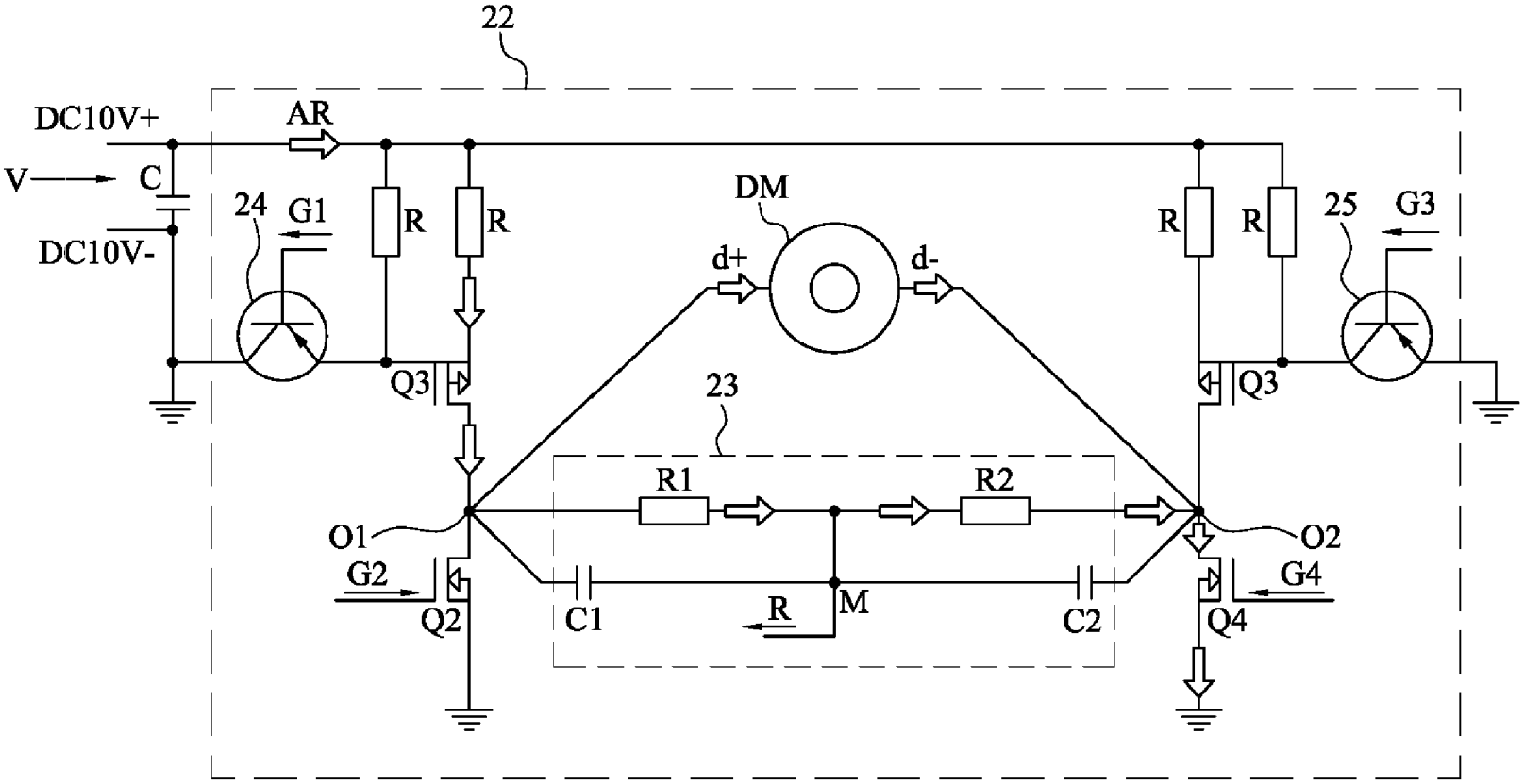
FIG. 4A illustrates an equivalent circuit diagram of the polarity correction circuit of the second embodiment where the polarity correction circuit is in a first switch state.
Figure 4B:
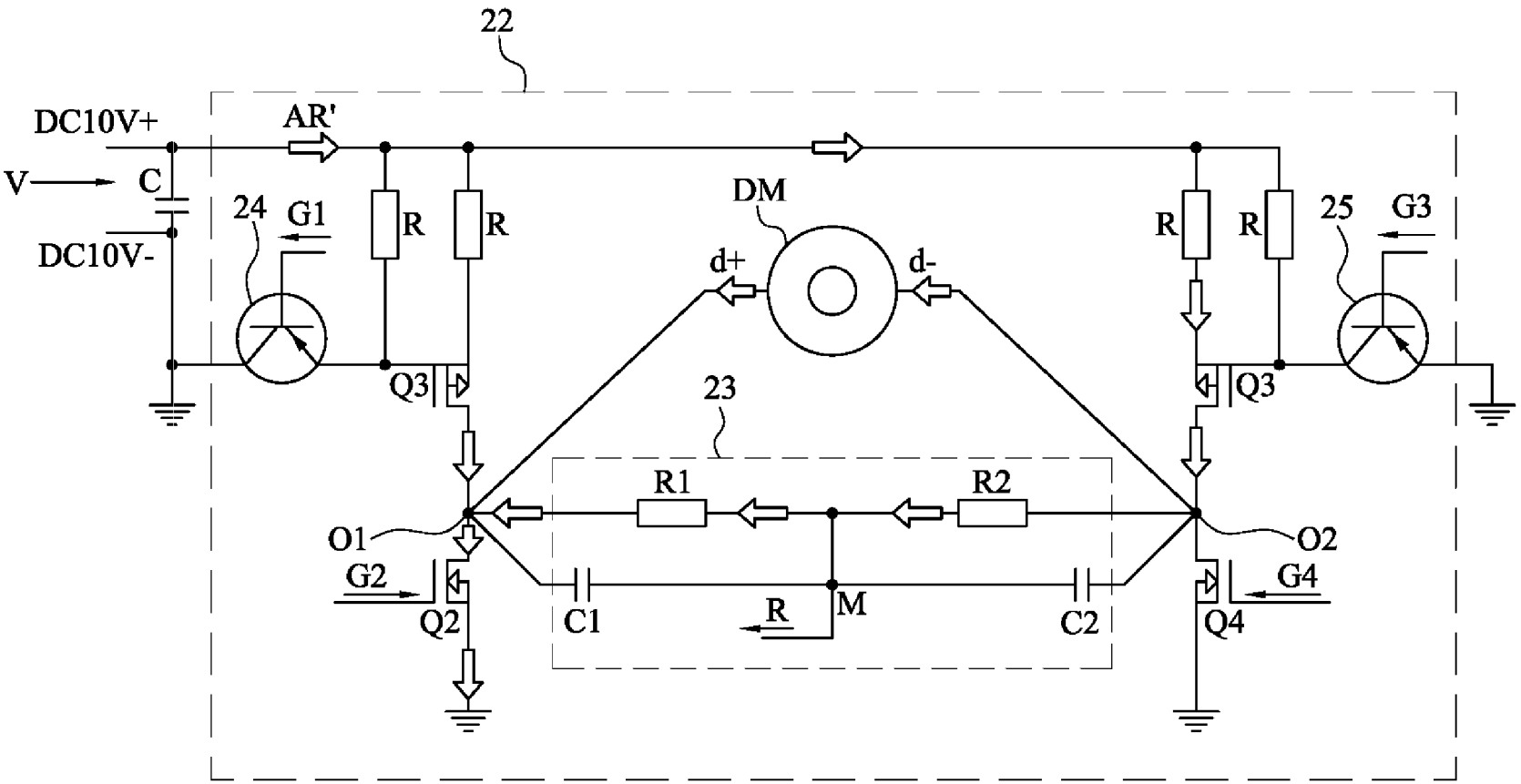
FIG. 4B illustrates an equivalent circuit diagram of the polarity correction circuit of the second embodiment where the polarity correction circuit is in a second switch state.

Please refer to FIG. 3, FIG. 4A, and FIG. 4B, which respectively illustrate an equivalent circuit diagram of the dimmer of the second embodiment, an equivalent circuit diagram of the polarity correction circuit of the second embodiment where the polarity correction circuit is in a first switch state, and an equivalent circuit diagram of the polarity correction circuit of the second embodiment where the polarity correction circuit is in a second switch state. As shown in FIG. 3, the equivalent circuit of the dimmer DM may be regarded as a series circuit comprising a variable resistor RL and a diode D1, and the series circuit has a positive electrode d+ and a negative electrode d−.

As it can be seen from FIG. 3, when the connection polarity is correct, the diode D1 is reverse biased to have a very high resistance. Therefore, the current passing through the dimmer DM is very small, and the voltage difference between the positive electrode d+ and the negative electrode d− of the dimmer DM increases apparently, so that the reference voltage R captured by the detection circuit 23 is a high voltage, namely, greater than the first reference voltage (for example, 0.38 V). Conversely, when the connection polarity is wrong, the diode D1 is forward biased, and the resistance of the diode D1 greatly decreases. Therefore, the current passing through the dimmer DM is very large, and the voltage difference between the positive electrode d+ and the negative electrode d− of the dimmer DM decreases apparently, so that the reference voltage R captured by the detection circuit 23 is a low voltage, namely less than the second reference voltage (for example, 0.36 V). Based on the foregoing mechanism, the reference voltage R captured by the detection circuit 23 can reflect if the connection polarity of the dimmer DM is correct or not effectively.

FIG. 4A illustrates an equivalent circuit diagram of the polarity correction circuit 2 of the second embodiment where the polarity correction circuit 2 is in a first switch state. FIG. 4B illustrates an equivalent circuit diagram of the polarity correction circuit 2 of the second embodiment where the polarity correction circuit 2 is in a second switch state. As shown in FIG. 4A, when the positive electrode d+ and the negative electrode d− of the dimmer DM are respectively connected to the first dimming signal output end O1 and the second dimming signal output end O2, and the switch signals G1, G2 output by the control circuit 21 are low level while the switch signals G3, G4 output by the control circuit 21 are high level (in other words, the control circuit 21 allows the first transistor Q1 to be in connection with the fourth transistor Q4 and allows the second transistor Q2 to be in disconnection with the third transistor Q3), the reference voltage R captured by the detection circuit 21 will be greater than the first reference voltage. Now, the positive electrode d+ of the dimmer DM is equivalently connected to the positive electrode (DC10V+) of the working voltage input end, and the current path is shown by the arrow AR. Since the connection polarity of the dimmer DM is correct, the control circuit 21 maintains the switch state of the adjustment circuit 22 to be in the first switch state. Next, the control circuit 21 can generate a control signal GS according to the current reference voltage R to drive the light source driver to perform the dimming function to the LED lamp.

When the connection between the polarity correction circuit 2 and the dimmer DM breaks, the control circuit 21 may record the current switch state of the adjustment circuit 22.

When the polarity correction circuit 2 is connected to the dimmer DM again, and the positive electrode d+ and the negative electrode d− of the dimmer DM are respectively connected to the second dimming signal output end O2 and the first dimming signal output end O1, since the current switch state of the adjustment circuit 22 is still the first switch state, the current switch state of the adjustment circuit 22 does not meet the current connection polarity of the dimmer DM. Therefore, the reference voltage R captured by the detection circuit 23 will be less than the second reference voltage. Hence, the control circuit 21 determines the connection polarity of the dimmer DM is wrong. Next, as shown in FIG. 4B, the control circuit 21 adjusts the output switch signals G1, G2 to be high level and adjusts the output switch signals G3, G4 to be low level (in other words, the control circuit 21 allows the first transistor Q1 to be in disconnection with the fourth transistor Q4 and allows the second transistor Q2 to be in connection with the third transistor Q3), so that the control circuit 21 switches the switch state of the adjustment circuit 22 to be in the second switch state. Now, the positive electrode d+ of the dimmer DM is equivalently connected to the negative electrode (DC10V−) of the working voltage input end, and the current path is shown by the arrow AR'. Hence, the current switch state of the adjustment circuit 22 can meet the current connection polarity of the dimmer DM. Next, the control circuit 21 can generate the control signal GS according to the current reference voltage R to drive the light source driver to perform the dimming function to the LED lamp, so that the LED lamp can work normally.

Therefore, when several LED lamps are in parallel connection with each other with one of the LED lamps having a wrong connection polarity with the dimmer, the polarity correction circuit 2 of that LED lamp can execute the aforementioned polarity correction mechanism to allow that LED lamp to work normally. Accordingly, the technician does not need to check the LED lamps one-by-one, thereby saving a great amount of time as well as meeting the requirements in actual applications.

Moreover, the automatic polarity correction mechanism may not only be applicable to an active dimmer but also a passive dimmer. Hence, the polarity correction circuit can be used flexibly and widely.

Nevertheless, it is understood that the foregoing descriptions are provided as illustrative examples; the components within the polarity correction circuit 2 and the corporations thereof may be altered according to actual needs, embodiments are not limited thereto.

The conventional LED lamp is devoid of the function for adjusting the polarity of the dimming signal. As a result, when the polarity of the dimming signal is wrong, the conventional LED lamp cannot correct the polarity of the dimming signal effectively, so that the LED lamp cannot work normally. Conversely, according to embodiment(s) of the present invention, the polarity correction circuit has the adjustment circuit and the detection circuit, so that the connection polarity of the dimmer can be detected if it is correct using the detection circuit. Further, when the connection polarity of the dimmer is wrong, the adjustment circuit can provide the polarity correction function. Therefore, the LED lamp connected to the dimmer can work normally.

Moreover, according to embodiment (s) of the present invention, a special H bridge structure is adopted for the adjustment circuit of the polarity correction circuit. Hence, the connection polarity of the dimmer can be checked effectively through a simple mechanism, and the connection polarity can be corrected instantly when the connection polarity of the dimmer is wrong.

Furthermore, according to embodiment(s) of the present invention, the detection circuit of the polarity correction circuit has a greater filtering function so as to generate a reference signal with low noises. Hence, the control circuit can recognize the reference signal accurately, thereby further improving the performance of the polarity correction circuit.

Moreover, the automatic polarity correction mechanism may not only be applicable to an active dimmer but also a passive dimmer. Hence, the polarity correction circuit can be used flexibly and widely. Hence, the present invention is not obvious and is patentable.

Figure 5:
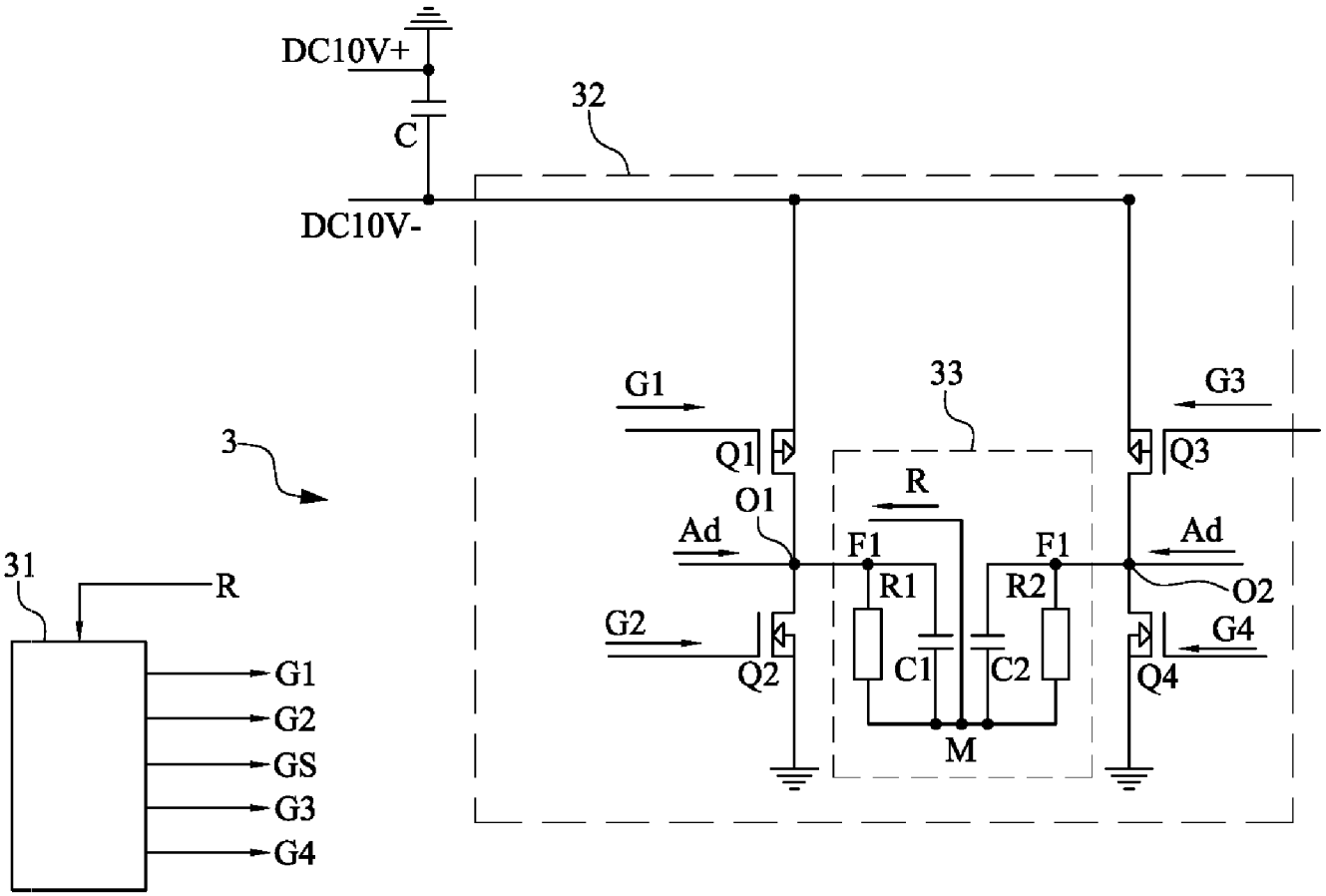
FIG. 5 illustrates a circuit diagram of a polarity correction circuit for dimmer according to a third embodiment of the present invention.

Please refer to FIG. 5, which illustrates a circuit diagram of a polarity correction circuit for dimmer according to a third embodiment of the present invention. This embodiment provides an alternative available circuit configuration for achieving the invention concept of the present invention. As shown, the polarity correction circuit for dimmer (polarity correction circuit 3 for short) may be connected to a dimmer, and the polarity correction circuit 3 comprises a control circuit 31, an adjustment circuit 32, and a detection circuit 33.

In this embodiment, the adjustment circuit 32 may be an H-bridge circuit comprising a first transistor Q1, a second transistor Q2, a third transistor Q3, and a fourth transistor Q4. The detection circuit 33 comprises a first resistor R1, a first capacitor C1, a second resistor R2, and a second capacitor C2. The detection circuit 33 has a first detection end F1 and a second detection end F2. The detection circuit 33 detects the dimming signal Ad to generate a reference voltage R and transmits the reference voltage R to the control circuit 31. Then, according to the reference voltage R occurred when the connection polarity of the dimmer is correct, the control circuit 31 can generate a control signal GS, and the control signal GS is input to the light source driver of the LED lamp so as to perform the dimming function to the LED lamp.

It is understood that the connections and corporations between the components within the polarity correction circuit 3 are similar to those described in the second embodiment and are omitted here. Being different from the second embodiment, in the third embodiment, the polarity correction circuit 3 is devoid of the first auxiliary circuit, the second auxiliary circuit, and several resistors.

Nevertheless, it is understood that the foregoing descriptions are provided as illustrative examples; the components within the polarity correction circuit 3 and the corporations thereof may be altered according to actual needs, embodiments are not limited thereto.

Figure 6:
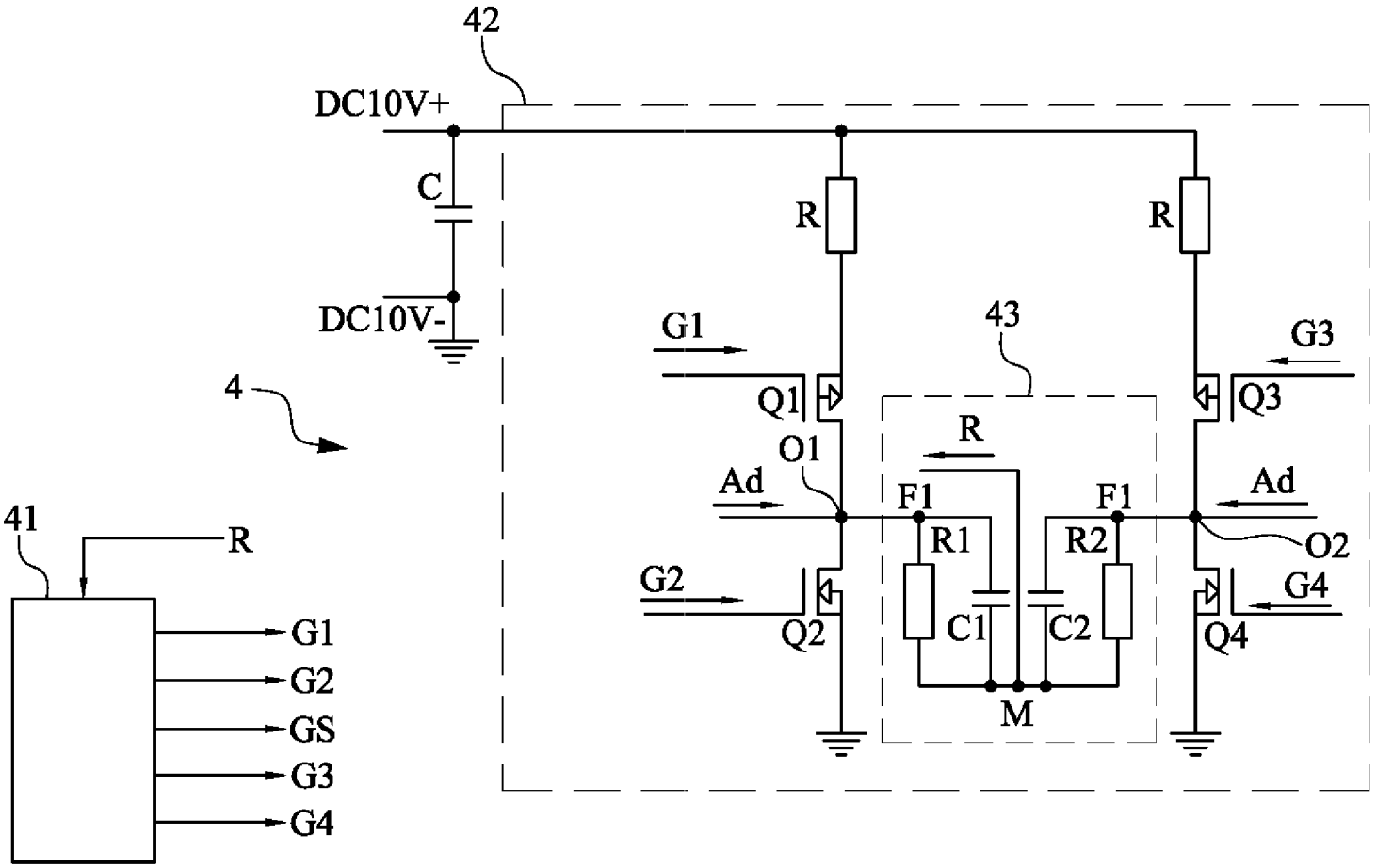
FIG. 6 illustrates a circuit diagram of a polarity correction circuit for dimmer according to a fourth embodiment of the present invention.

Please refer to FIG. 6, which illustrates a circuit diagram of a polarity correction circuit for dimmer according to a fourth embodiment of the present invention. This embodiment provides an alternative available circuit configuration for achieving the invention concept of the present invention. As shown, the polarity correction circuit for dimmer (polarity correction circuit 4 for short) may be connected to a dimmer, and the polarity correction circuit 4 comprises a control circuit 41, an adjustment circuit 42, and a detection circuit 43.

Similarly, in this embodiment, the adjustment circuit 42 may be an H-bridge circuit comprising a first transistor Q1, a second transistor Q2, a third transistor Q3, and a fourth transistor Q4. The detection circuit 43 comprises a first resistor R1, a first capacitor C1, a second resistor R2, and a second capacitor C2. The detection circuit 43 has a first detection end F1 and a second detection end F2. The detection circuit 43 detects the dimming signal Ad to generate a reference voltage R and transmits the reference voltage R to the control circuit 41. Then, according to the reference voltage R occurred when the connection polarity of the dimmer is correct, the control circuit 41 can generate a control signal GS, and the control signal GS is input to the light source driver of the LED lamp so as to perform the dimming function to the LED lamp.

It is understood that the connections and corporations between the components within the polarity correction circuit 4 are similar to those described in the third embodiment and are omitted here. Being different from the third embodiment, in the fourth embodiment, two resistors R are further provided between the polarity correction circuit 4 and the working voltage input end.

Nevertheless, it is understood that the foregoing descriptions are provided as illustrative examples; the components within the polarity correction circuit 4 and the corporations thereof may be altered according to actual needs, embodiments are not limited thereto.

Figure 7:
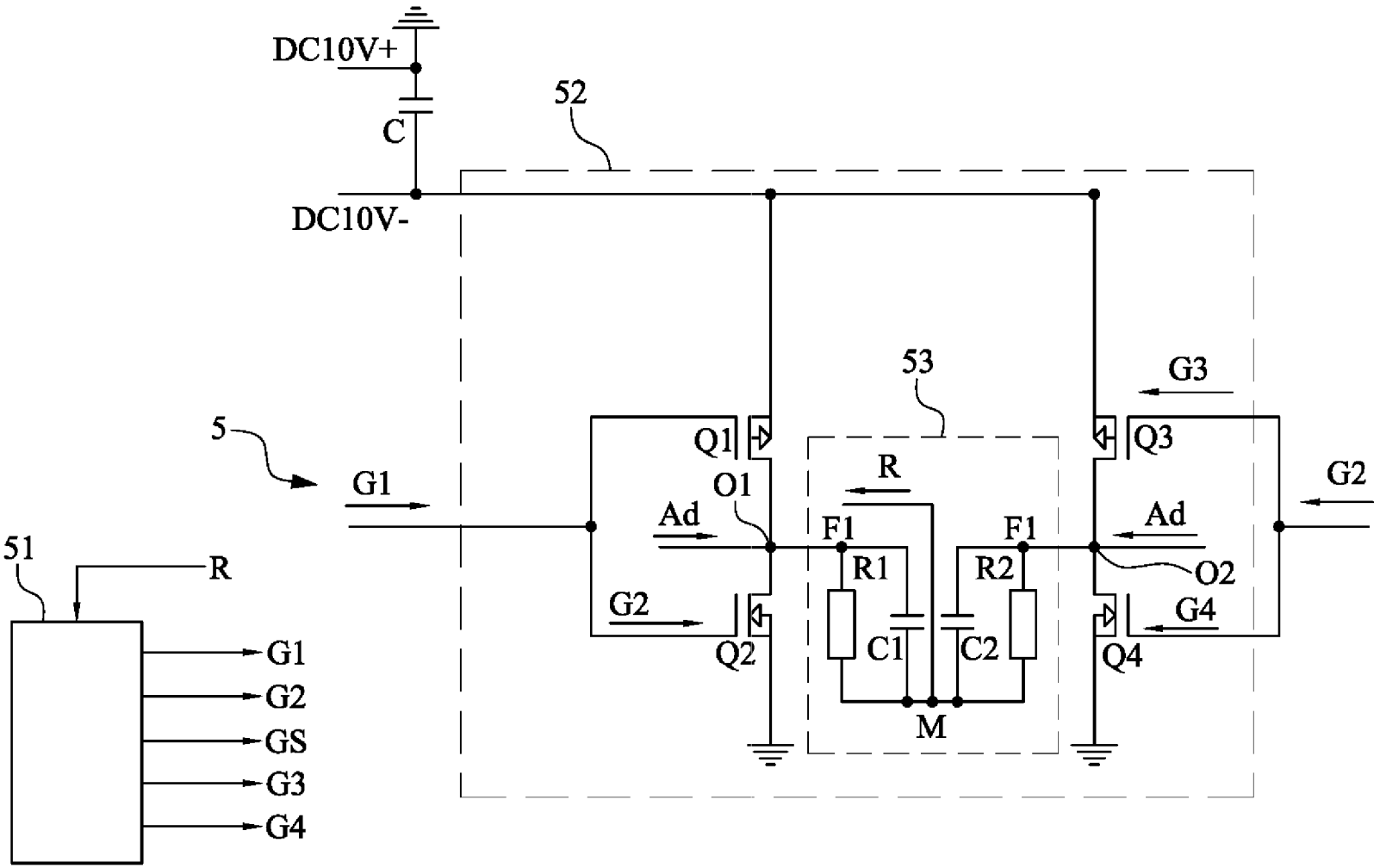
FIG. 7 illustrates a circuit diagram of a polarity correction circuit for dimmer according to a fifth embodiment of the present invention.

Please refer to FIG. 7, which illustrates a circuit diagram of a polarity correction circuit for dimmer according to a fifth embodiment of the present invention. This embodiment provides an alternative available circuit configuration for achieving the invention concept of the present invention. As shown, the polarity correction circuit for dimmer (polarity correction circuit 5 for short) may be connected to a dimmer, and the polarity correction circuit 5 comprises a control circuit 51, an adjustment circuit 52, and a detection circuit 53.

Similarly, in this embodiment, the adjustment circuit 52 may be an H-bridge circuit comprising a first transistor Q1, a second transistor Q2, a third transistor Q3, and a fourth transistor Q4. The detection circuit 53 comprises a first resistor R1, a first capacitor C1, a second resistor R2, and a second capacitor C2. The detection circuit 53 has a first detection end F1 and a second detection end F2. The detection circuit 53 detects the dimming signal Ad to generate a reference voltage R and transmits the reference voltage R to the control circuit 51. Then, according to the reference voltage R occurred when the connection polarity of the dimmer is correct, the control circuit 51 can generate a control signal GS, and the control signal GS is input to the light source driver of the LED lamp so as to perform the dimming function to the LED lamp.

It is understood that the connections and corporations between the components within the polarity correction circuit 5 are similar to those described in the fourth embodiment and are omitted here. Being different from the fourth embodiment, in the fifth embodiment, the two resistors R between the polarity correction circuit 4 and the working voltage input end in the fourth embodiment are omitted. Moreover, in this embodiment, the gate of the first transistor Q1 is connected to the gate of the second transistor Q2 to receive the switch signal G1 of the control circuit 51, and the gate of the third transistor Q3 is connected to the gate of the fourth transistor Q4 to receive the switch signal G2 of the control circuit 51. When the switch signal G1 output by the control circuit 51 is low level and the switch signal G2 is high level, the first transistor Q1 is in connection with the fourth transistor Q4, and the second transistor Q2 is in disconnection with the third transistor Q3. Conversely, when the switch signal G1 output by the control circuit 51 is high level and the switch signal G2 is low level, the first transistor Q1 is in disconnection with the fourth transistor Q4, and the second transistor Q2 is in connection with the third transistor Q3.

Nevertheless, it is understood that the foregoing descriptions are provided as illustrative examples; the components within the polarity correction circuit 5 and the corporations thereof may be altered according to actual needs, embodiments are not limited thereto.

Based on the above, according to embodiment(s) of the present invention, the polarity correction circuit has the adjustment circuit and the detection circuit, so that the connection polarity of the dimmer can be detected if it is correct using the detection circuit. Further, when the connection polarity of the dimmer is wrong, the adjustment circuit can provide the polarity correction function. Therefore, the LED lamp connected to the dimmer can work normally.

Moreover, according to embodiment (s) of the present invention, a special H bridge structure is adopted for the adjustment circuit of the polarity correction circuit. Hence, the connection polarity of the dimmer can be checked effectively through a simple mechanism, and the connection polarity can be corrected instantly when the connection polarity of the dimmer is wrong.

Furthermore, according to embodiment(s) of the present invention, the detection circuit of the polarity correction circuit has a greater filtering function so as to generate a reference signal with low noises. Hence, the control circuit can recognize the reference signal accurately, thereby further improving the performance of the polarity correction circuit.

Moreover, according to embodiment (s) of the present invention, the circuit of the polarity correction circuit may not only be applicable to an active dimmer but also a passive dimmer. Hence, the polarity correction circuit can be used flexibly and widely.

According to embodiment(s) of the present invention, the circuit of the polarity correction circuit is simple. Hence, the expected performance can be achieved without greatly increasing the manufacturing costs of circuit. Accordingly, the polarity correction circuit has commercial value.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A polarity correction circuit for dimmer, comprising: a control circuit; an adjustment circuit, connected to the control circuit, an working voltage input end, and a dimmer, wherein the adjustment circuit comprises a plurality of switches, and the adjustment circuit receives a dimming signal of the dimmer; and a detection circuit connected to the dimmer and the control circuit, wherein the detection circuit detects the dimming signal to generate a reference voltage, and the detection circuit transmits the reference voltage to the control circuit; wherein the control circuit maintains a switch state of the switches of the adjustment circuit unchanged or adjusts the switch state of the switches of the adjustment circuit according to the reference voltage, wherein the adjustment circuit comprises a first transistor, a second transistor, a third transistor, and a fourth transistor; a first end of the first transistor is connected to the raking voltage input end, a second end of the first transistor is connected to a first dimming signal output end, a third end of the first transistor is connected to the control circuit; a first end of the second transistor is rounded, a second end of the second transistor is connected to the first dimming signal output end, and a third end of the second transistor is connected to the control circuit: a first end of the third transistor is connected to the working voltage in out end, a second end of the third transistor is connected to a second dimming signal output end, a third end of the third transistor is connected to the control circuit; a first end of the fourth transistor is grounded, a second end of the fourth transistor is connected to the second dimming signal output end and a third end of the fourth transistor is connected to the control circuit; the first dimming signal output end and the second dimming signal output end receive and output the dimming signal.

2. The polarity correction circuit for light modular as claimed in claim 1, wherein the control circuit generates a control signal according to the reference voltage, and the control circuit outputs the control signal to a light source driver.

3. The polarity correction circuit for dimmer as claimed in claim 2, wherein the control signal is a pulse width modulation signal.

4. The polarity correction circuit for dimmer as claimed in claim 3, wherein the control circuit adjusts a duty ratio of the pulse width modulation signal according to the reference voltage.

5. The polarity correction circuit for dimmer as claimed in claim 1, wherein when the reference voltage is greater than a first threshold value, the control circuit maintains the switch state of the switches of the adjustment circuit unchanged.

6. The polarity correction circuit for dimmer as claimed in claim 1, wherein the first threshold value is 0.38 V.

7. The polarity correction circuit for dimmer as claimed in claim 1, wherein when the reference voltage is less than a second threshold value, the control circuit adjusts the switch state of the switches of the adjustment circuit to reverse a polarity of the dimming signal.

8. The polarity correction circuit for dimmer as claimed in claim 7, wherein the second threshold value is 0.36 V.

9. the polarity correction circuit for dimmer as claimed in claim 1, wherein the first transistor and the third transistor are of a first type transistor, and the second transistor and the fourth transistor are of a second type transistor.

10. The polarity correction circuit for dimmer as claimed in claim 9, wherein the first type transistor is a p-MOSFET, and the second type transistor is an n-MOSFET.

11. The polarity correction circuit for dimmer as claimed in claim 9, wherein the first type transistor is an n-MOSFET, and the second type transistor is a p-MOSFET.

12. the polarity correction circuit for dimmer as claimed in claim 1, wherein when the reference voltage is greater than a first threshold value, the control circuit allows the first transistor to be in connection with the fourth transistor and allows the second transistor to be in disconnection with the third transistor.

13. the polarity correction circuit for dimmer as claimed in claim 1, wherein when the reference voltage is less than a second threshold value, the control circuit allows the second transistor to be in connection with the third transistor and allows the first transistor to be in disconnection with the fourth transistor.

14. The polarity correction circuit for dimmer as claimed in claim 1, wherein the detection circuit comprises a first resistor, a first capacitor, a second resistor, and a second capacitor; one of two ends of the first resistor is connected to a first dimming signal output end, and the other end of the first resistor is connected to a common node; the first capacitor is in parallel connection with the first resistor; one of two ends of the second resistor is connected to a second dimming signal output end, and the other end of the second resistor is connected to the common node; the second capacitor is in parallel connection with the second resistor.

* * * * *